United States Patent [19]

Wiley et al.

[11] Patent Number: 4,461,431

[45] Date of Patent: Jul. 24, 1984

[54] EDGE GUIDE UNWINDING APPARATUS

[75] Inventors: Thomas W. Wiley, Asheville; William R. Joyce, Gerton, both of N.C.

[73] Assignee: Tex-Fab, Inc., Gerton, N.C.

[21] Appl. No.: 264,974

[22] Filed: May 18, 1981

[51] Int. Cl.[3] ..... B65H 25/26

[52] U.S. Cl. ..... 242/57.1; 226/19

[58] Field of Search ..... 242/57.1; 226/5, 15, 226/16, 12, 18, 19, 20, 21, 22, 23; 250/548, 561, 571

[56] References Cited

U.S. PATENT DOCUMENTS

| | | | |
|---|---|---|---|
| 2,078,669 | 4/1937 | King | 242/57.1 |
| 2,078,699 | 4/1937 | Taylor et al. | 141/8 |
| 2,641,416 | 6/1953 | McCleary | 242/57.1 |
| 2,672,300 | 3/1954 | Hogan | 242/57.1 |
| 2,860,841 | 4/1958 | Jacobsen | 242/57.1 |
| 3,310,942 | 3/1967 | Stanford | 60/52 |
| 3,559,859 | 10/1968 | McArthur | 226/19 |
| 3,570,723 | 3/1971 | Kurz | 226/3 |
| 3,599,849 | 8/1971 | Callan | 226/22 |
| 3,931,940 | 1/1976 | Raighn et al. | 242/57.1 X |
| 3,955,772 | 5/1976 | Chisholm | 242/66 |
| 4,106,715 | 8/1978 | Pisani | 242/57.1 |

*Primary Examiner*—Stuart S. Levy
*Assistant Examiner*—Lloyd D. Doigan
*Attorney, Agent, or Firm*—Luedeka & Neely

[57] ABSTRACT

An apparatus for monitoring and correcting deviations in the transverse position of a longitudinally traveling web of material as it unwinds from a supply roll of material includes a cradle unwinder for supporting the supply roll and unwinding the web from the supply roll. The cradle unwinder is mounted for movement in the transverse direction of the moving web and includes a reversible motor for causing the cradle unwinder to move transversely. A web edge detector device is located downstream of the cradle unwinder to monitor the transverse position of the moving web. As deviations in the transverse position of the web occur, the edge detector sends a signal energizing the motor causing it to turn in one direction or the other to in turn cause the cradle unwinder to move transversely in a direction to correct the transverse deviation in the position of the moving web. The cradle unwinder also includes a movable device for adapting the cradle unwinder to support supply rolls of material of different widths.

8 Claims, 8 Drawing Figures

EDGE GUIDE UNWINDING APPARATUS

The present invention relates to advancing a web of material and more particularly to an apparatus for unwinding a web of material from a supply roll which is transversely shiftable to correct for transverse deviations in the position of the web as it is being unwound.

There are numerous situations wherein process operations are performed on a moving web of material which require that the moving web of material be maintained in alignment with a minimum amount of transverse deviation from a desired path. Such process operations include, for example, printing or coating the moving web, slitting the moving web lengthwise, and cutting the moving web transversely to form patches of material.

The transverse deviations must not only be corrected, but they must be corrected in a minimum time period so that the process operations will not be adversely effected.

Also, of course, various process operations are performed on fabric webs of diffent widths depending upon the final product.

An object of the present invention is to provide an apparatus for unwinding a web of material from a supply roll, and monitoring and correcting transverse deviations of the web from the desired path of travel.

It is another object of the present invention to provide an apparatus which rapidly corrects transverse deviations in the path of travel of the web.

It is a further object of the present invention to provide an apparatus for unwinding supply rolls of various widths.

It is a still further object of the present invention to provide an apparatus of the above-described class which is straightforward and relatively simple to maintain in operation.

Other objects and advantages of the invention will become known by reference to the following description and drawings in which.

Figure 1:
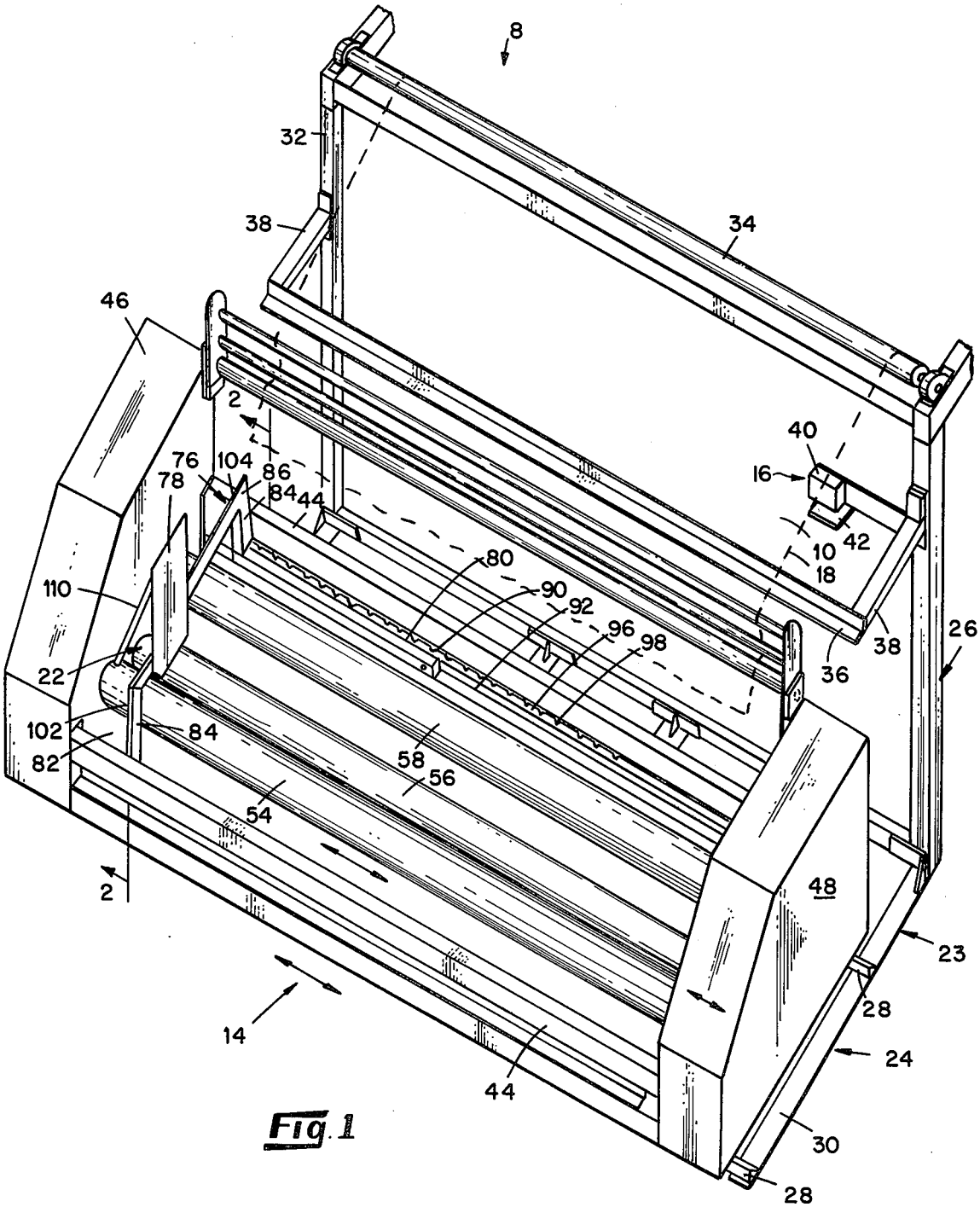
FIG. 1 is an isometric view of an apparatus for unwinding a web of material from a supply roll and controlling lateral deviations in a traveling web embodying various features of the present invention.
Figure 2:
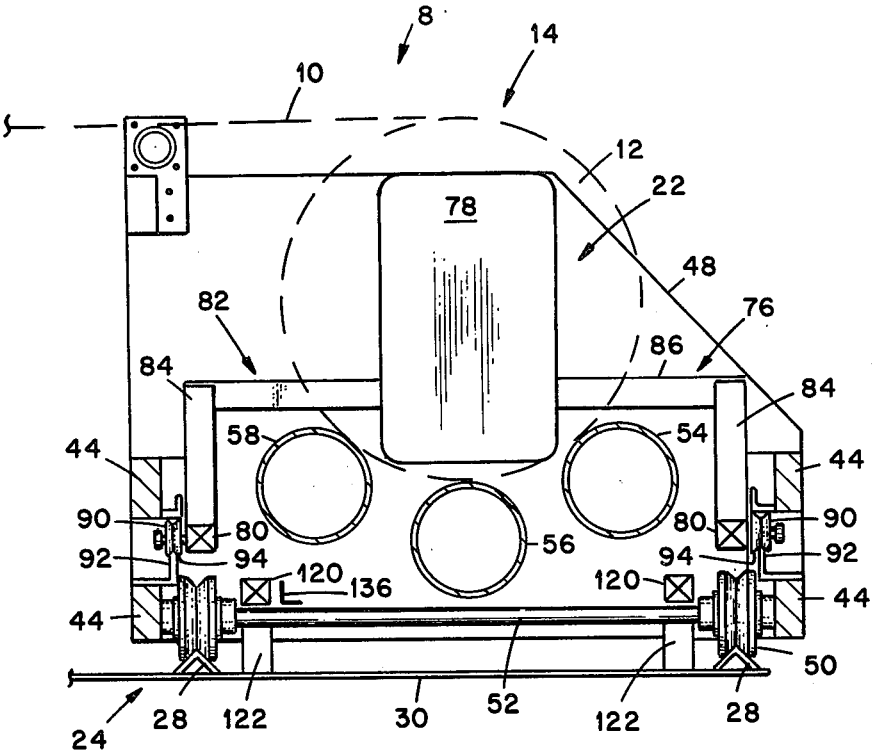
FIG. 2 is a cross-sectional end view of the cradle unwinder component of the apparatus of FIG. 1.

The illustrated embodiment, in general, provides an apparatus, generally denoted as the numeral 8, for monitoring and controlling the alignment of a continuously moving web 10 of material being unwound from a supply roll 12 of material (supply roll 12 is omitted in FIG. 1 and is shown in broken lines in FIG. 2). The apparatus 8 includes a cradle unwinder 14 for supporting the supply roll 12 and unwinding the continuously moving web 10 of material from the supply roll 12. The cradle unwinder 14 is mounted for selective movement transversely of the web 10 of material. A web edge detector 16 is located downstream from the cradle unwinder 14 in the direction of movement of the moving web 10 at one edge 18 of the web unwound from the supply roll 12 for detecting when the moving web 10 deviates transversely from the desired alignment or path. The cradle unwinder 14 further includes means, such as an electric motor 20 (shown in FIG. 3) which is operatively associated with the edge detector 16, for moving the cradle unwinder 14 in a transverse direction in response to a signal from the detector 16 indicating the moving web 10 has transversely deviated from the desired alignment thereby correcting the alignment of the web 10. The cradle unwinder 14 also includes supply roll adjustment means 22 for adapting the cradle unwinder 14 to support supply rolls of different widths.

With reference to FIG. 1, the apparatus 8 includes a frame work, generally denoted as the numeral 23, comprised of a horizontal floor mounted section 24 and an upright section 26 connected to and extending upwardly from one end of the floor mounted section 24. The floor mounted section 24 is formed of at least two parallel spaced apart elongated transverse structural members 28 and at least two spaced apart elongated longitudinal structural members 30 intersecting and connected to the transverse structural members 28. The transverse structural members 28 are of inverted V-shaped cross-section to function as rails for the cradle unwinder 14. The transverse structural members 28 can be, for example, angle iron and the longitudinal structural members can be flat plates connected to the transverse structural members 28 by, for example, welding. The upright section 26 includes two parallel spaced apart elongated vertical structural members 32, which are each connected at one end to and extend vertically upwardly from different ones of the longitudinal structural members 30 of the floor mounted section 24. The vertical structural members 32 can be, for example, angle iron and can be connected to the longitudinal structural members 30 by, for example, welding. A web support roller 34 extends horizontally laterally between the vertical members 32 and is journaled at its opposite ends to different ones of the vertical members 32 for free rotation. The upright section 26 also includes a web hold down bar 36 which extends horizontally transversely between the two vertical members 32 and is attached thereto by means of cantilevered bars 38 extending from the vertical members 32. The hold down bar 36 and cantilevered bars 38 can be formed of lengths of angle iron and can be connected by, for example, welding.

The edge detector 16 is illustrated as comprising a photoelectric cell 40 having a light source mounted to one of the vertical structural members 32 of the upright section 26 of the framework 23 and a light reflecting member 42 spaced below and in general vertical alignment with the photoelectric cell 40 to reflect a light beam back to the photoelectric cell 40. The web 10 passes through the space between the photoelectric cell 40 and the light reflecting member 42.

Now with reference to FIGS. 1 and 2, the cradle unwinder 14 is illustrated as being constructed of a plurality of transversely extending elongated generally parallel spaced apart structural members 44 and two spaced apart end wall structures 46 and 48 connected to opposite ends of the transversely extending parallel structural members 44. The elongated structural members 44 are shown as box beams and the end wall structures 46 and 48 as a hollow box construction of metal walls welded together. The end wall structures 46 and 48 are attached to the elongated structural members by virtually any conventional or otherwise convenient means such as by welding or bolting. The cradle unwinder 14 is mounted for transverse movement by means of casters 50. The casters 50 are disposed in pairs with the casters of a pair interconnected by an axle 52. The axles 52 are mounted to the elongated structural members 44 and the casters 50 ride on the inverted V-shaped transverse structural or track members 28 of the floor mounted section 24 of the framework 23.

Figure 3:
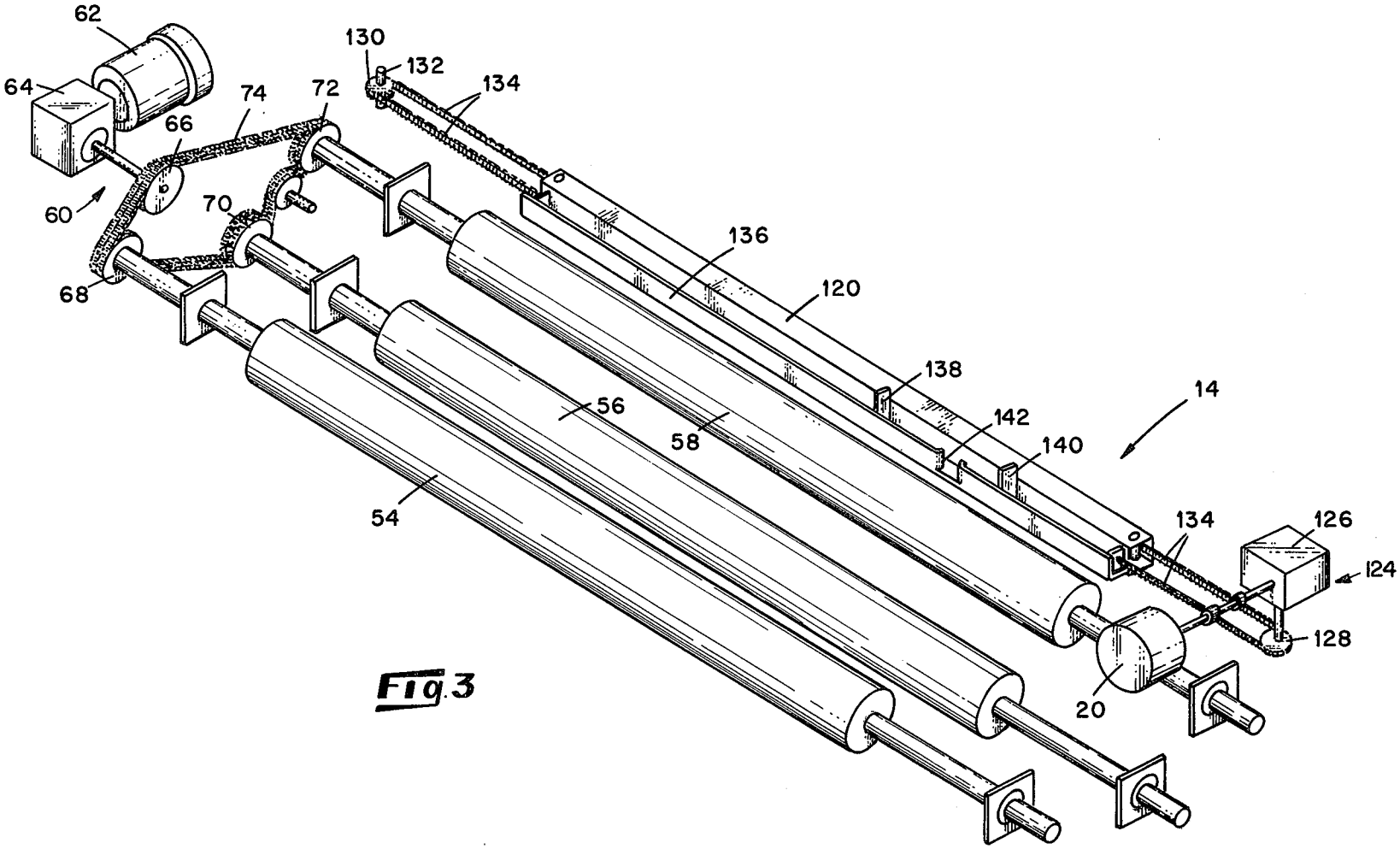
FIG. 3 is an isometric view of a portion of the cradle unwinder of FIG. 1.

With reference to FIGS. 1, 2 and 3, the cradle unwinder 14 further comprises three spaced apart mutually parallel supply roll support rollers 54, 56 and 58 disposed in the cradle unwinder. Each supply roll support roller 54, 56 and 58 is journal mounted at one of its ends to one end wall structure 46 and journal mounted at its opposite end to the other end wall structure 48. The middle one of the supply roll support rollers 56 is located below the other two supply roll support rollers 54 and 58 to form a saddle in which the supply roll 12 rests and so that the supply roll 12 contacts all three support rollers 54, 56 and 58. All three support rollers 54, 56 and 58 are rotatably power driven by means of, for example, a support roll chain drive system, generally denoted as the numeral 60. As shown, the support roll chain drive system 60 is mounted inside one of the end wall structures, for example end wall 46, of the cradle unwinder 14. As illustrated the support roll chain drive system 60 includes an electric motor 62 with a variable speed control 64. A driving chain sprocket 66 is attached to the output shaft of the speed control 64 for rotation therewith. A different driven chain sprocket 68, 70 and 72 is attached to one end of each supply roll support roller 54, 56 and 58, respectively. A drive chain 74 encompasses the driving chain sprocket 66 and driven chain sprockets 68, 70 and 72 so that the rollers 54, 56 and 58 are rotatably driven by the electric motor 62.

As illustrated in FIGS. 1, 2, 4, 5 and 6, the supply roll adjustment means 22 comprises a laterally movably mounted truck 76 having a supply roll abutting means 78. The truck 76 comprises two spaced apart parallel horizontally disposed side frame rails 80 and an upright end frame structure 82. The end frame structure 82 is formed of two vertical elongated structural members 84 each attached at one end to a different one of the side frame rails 80, and a horizontal elongated structural member 86 spanning the two vertical structural members 84 and attached at its opposite ends to the upper ends of the vertical members 84. A third vertical structural member 88 is attached at one of its ends to the horizontal structural member 86 between the ends of horizontal member 86 and extends upwardly therefrom. The two vertical structural members 84, the horizontal structural member 86 and the third vertical structural member 88 are illustrated as being lengths of angle iron and the side frame rails 80 as box beams. The attachment of the vertical members 84 to the frame rails 80, and of the vertical members 84 and 88 to the horizontal member 86 can be by virtually any conventional or otherwise convenient means such as, for example, welding or bolting. The supply roll abutment means is illustrated as a vertically disposed supply roll planar abuttment plate 78 fabricated of metal and attached to the upright end frame structure 82 at the third vertical member 88 and horizontal member 86 by virtually any conventional or otherwise convenient means such as welding or bolting. The abuttment plate 78 is adapted to abut one end of the supply roll 12. The truck 76 is mounted for transverse movement relative to the web 10 in the direction of the longitudinal axis of the supply roll support rollers 54, 56 and 58 by means of casters 90 which are rotatably attached to the side frame rails 80. The casters 90 travel on two parallel spaced apart transversely extending tracks 92 which are connected to the transverse structural members 44 of the cradle unwinder 14. The tracks 92 are parallel to the three support rollers 54, 56 and 58 and are disposed to either side of the three support rollers 54, 56 and 58. As illustrated, each track 92 is a length of angle iron with one leg horizontally disposed and resting on the top surface of one of the box beam structural members 44 and the other leg extending vertically upwardly. The casters 90 are formed with a peripheral groove 94 to receive the upwardly extending leg of the track 92 so that the truck 76 will follow the tracks 92.

Figure 4:
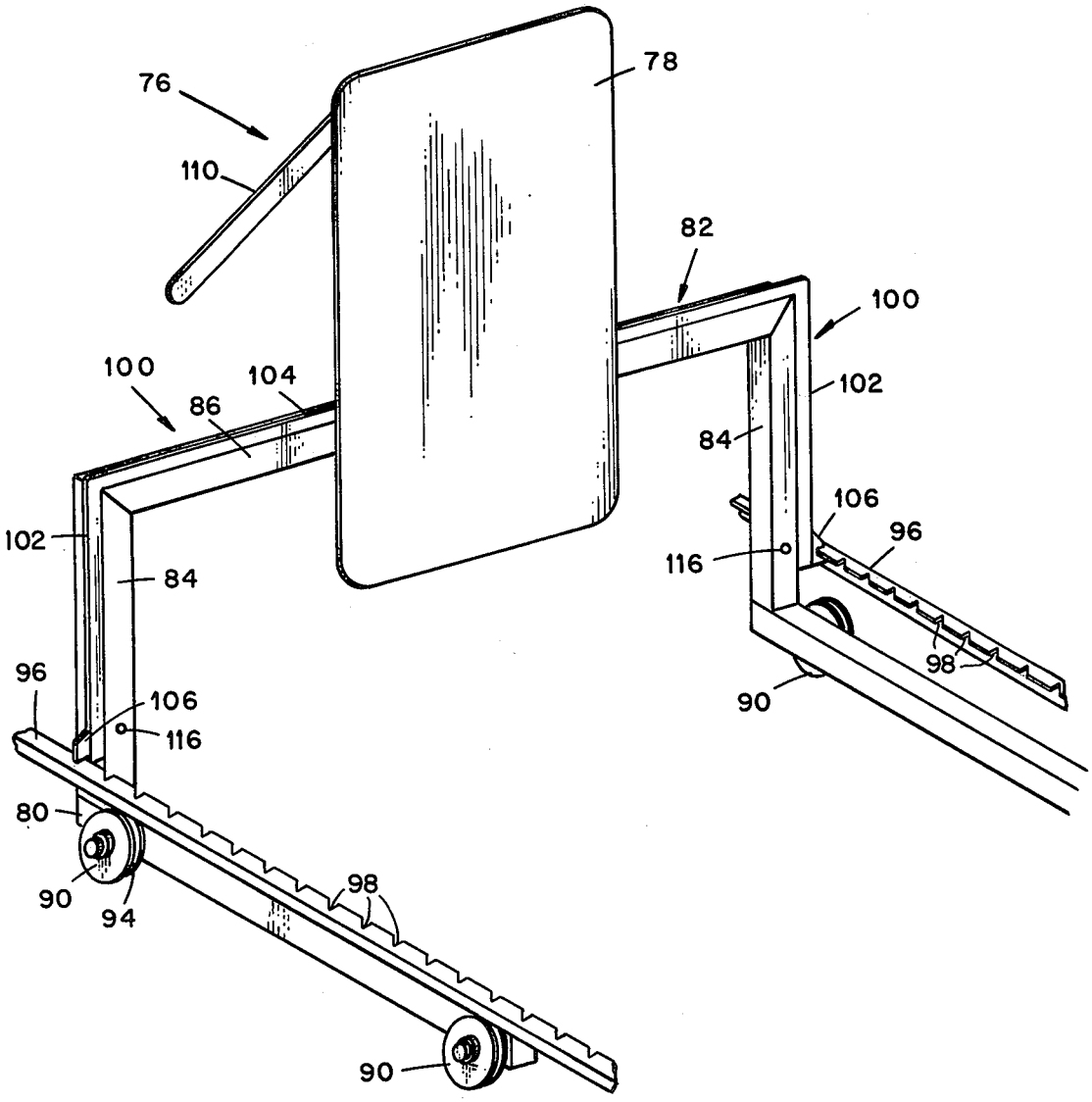
FIG. 4 is an isometric view of a component of the cradle unwinder.
Figure 5:
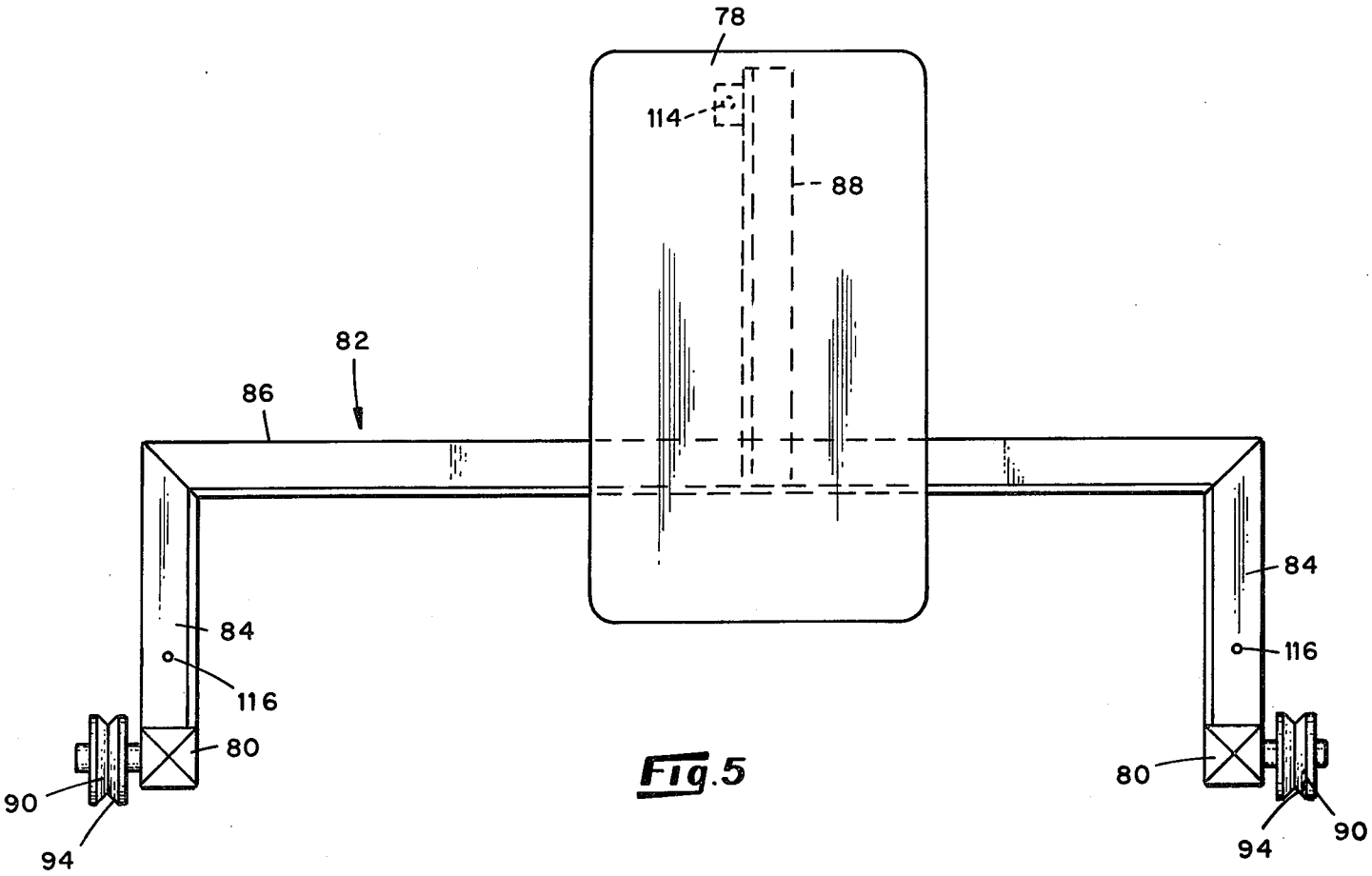
FIG. 5 is a front view of a part of the component of FIG. 4.
Figure 6:
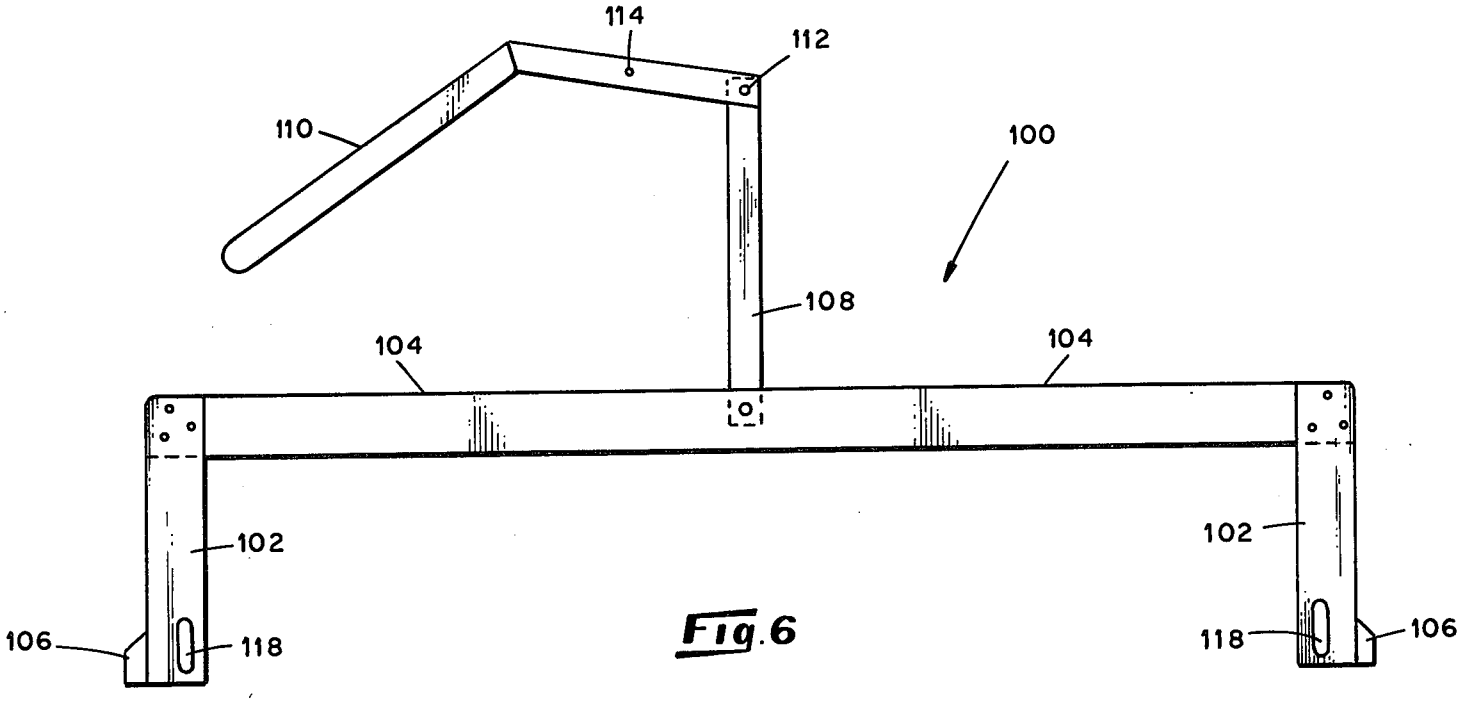
FIG. 6 is a front view of another part of the component of FIG. 4.

As illustrated in FIGS. 1, 4, 5 and 6, the movable truck 76 is selectively held fast at a desired position relative to the longitudinal axis of supply rollers 54, 56 and 58 and in abuttment with one end of a supply roll 12 by lock means comprising two laterally extending lock bars 96 generally parallel to the longitudinal axis of the support rollers 54, 56 and 58, spaced apart to either side of the three support rollers 54, 56 and 58, and attached to the cradle unwinder 14. The two lock bars 96 are spaced wider apart than the two side frame rails 80 of the truck 76 so that the truck 76 is straddled by the lock bars 96. The lock bars 96 each have a series of detents 98 spaced apart longitudinally of the bar 96. The detents 98 are selectively engaged by means of a locking mechanism 100 movably attached to the upright end frame structure 82 of the truck 76. As shown in FIGS. 4, 5 and 6, the locking mechanism 100 is similar in size and shape to the upright end frame structure 82 and comprises two vertical elongated plates 102 spaced apart a distance generally corresponding to the distance between the two vertical elongated structural members 84 of the end frame structure 82, and a horizontal elongated plate 104 spanning the distance between the vertical elongated plates 102 and attached to the upper ends of the vertical elongated plates 102 at its opposite ends. Detent engaging plates 106 are attached to the bottom ends of the vertical elongated plates 102 and extend transversely outwardly of the elongated plates 102 for selectively engaging the detents 98 in the lock bars 96. A third vertical elongated plate 108 is attached at one of its ends to the horizontal plate 104 between the ends of the horizontal plate and extends upwardly therefrom. The two parallel vertical elongated plates 102, the horizontal elongated plate 104 and the third vertical elongated plate 108 are illustrated as being lengths of flat metal stock. The attachment of the vertical plates 102 to the horizontal plate 104, and of the third vertical plate 108 to the horizontal plate 104 can be by virtually any conventional or otherwise convenient means such as, for example, welding or bolting. The locking mechanism 100 generally overlays or is superimposed on the upright end frame structure 82 and is attached to the upright end frame structure 82 for selective movement relative thereto in a vertical direction. When superimposed on the upright end frame structure 82, each of the vertical elongated plates 102 overlie a different one of the vertical elongated members 84 of the end structure 82, the elongated horizontal plate 104 generally overlays the elongated horizontal structural member 86, but the third vertical elongated plate 108 is parallel to and spaced from the third vertical structural member 88 of the end frame structure 84. A lever arm 110 is pivotally attached at one of its ends 112 to the upper end of the third vertical elongated plate 108 and is also pivotally attached between its ends to the upper end of the third vertical elongated structural member 88 of the end frame structure 82 to form a fulcrum point 114. Each of the two vertical elongated plates 102 are movably interconnected to the one of the two vertical elongated members 84 of the end frame structure 82 over which it is superimposed by means of, for example, a pin 116 attached to and projecting outwardly from each of the vertical elongated member 84 toward the overlaying vertical elongated plate 102 and a vertically oriented elongated slot 118 formed in each of the vertical elongated plates 102. The pins 116 are slidably received in the elongated slots 118. As the lever arm 110 is pivoted about the fulcrum point 114, in one direction, the locking mechanism 100 moves vertically upwardly raising the detent engaging plates 106 upwardly out of engagement with the detents 98, and as the lever arm 110 is pivoted about the fulcrum point 114 in the opposite direction the locking mechanism 100 moves vertically downwardly lowering the detent engaging plates 106 downwardly into engagement with the detents 98.

As can be best seen in FIG. 2, the cradle unwinder 14 is restrained against movement in a vertical direction which would cause the casters 50 to leave the inverted V-shaped lateral track members 28 of the floor mounted section 24 by means of two spaced apart parallel restraining bars 120. These restraining bars 120 are spaced above the floor mounted section 24 and extend generally parallel to the inverted V-shaped lateral track members 28 in overlaying relationship to the axles 52 interconnecting pairs of casters 50. The restraining bars 120 are supported above the floor section 24 by pedestal members 122.

As can be best seen in FIG. 3, the cradle unwinder 14 is moved by means of, for example, a cradle chain drive system, generally denoted as the numeral 124. As illustrated, the cradle chain drive system includes the reversible, low speed, high torque electric motor 20 which is energized in response to a signal from the web edge detector 16. The electric motor 20 is of the type which come to speed rapidly, which are rapidly reversible and which do not coact excessively. Examples of such motors are alternating current, synchronous permanent magnet constant speed motors having a starting current the same as running current, and direct current stepping motors. As shown, the electric motor 20 is connected to a speed reducer 126 and both are mounted on the cradle unwinder 14 inside one of the end wall structures, for example wall 48. The output shaft of the speed reducer 126 has a driving chain sprocket 128 attached for rotation with the speed reducer output shaft. An idler chain sprocket 130 is spaced from the speed reducer chain sprocket 128 across the cradle unwinder 14 from the mounting position of the speed reducer 126 and is located inside the other one of the end wall structures 46. The idler chain sprocket 130 is attached to a shaft 132, for example, which is journal mounted to the cradle unwinder. A drive chain 134 encompasses the driving chain sprocket 128 and the idler chain sprocket 130. The chain 134 is fixedly connected at one of its flights or lengths between the idler chain sprocket 130 and speed reducer chain sprocket 128 to a fixed position member, for example, one of the cradle unwinder restraining bars 120. In function, the restraining bar 120 here is as a force reaction member to the driving force generated in the chain 134 through the speed reducer from the electric motor 20. When the motor 20 is energized the speed reducer driving chain sprocket 128 is rotated applying a driving force to the chain 134. However, the chain 134 is held against movement relative to and about the speed reducer chain sprocket 128 and idler chain sprocket 130 due to the fact it is fixedly attached to the stationary force reaction member or restraining bar 120. Therefore, the speed reducer chain sprocket 128 and idler chain sprocket 130 will move relative to or along the chain 134. Because the speed reducer 126 and motor 20 are attached to the cradle unwinder 14, the driving force is transferred to the cradle unwinder 14 causing it to move along the elongated inverted V-shaped track members 28 of the floor mounted frame section 24 on the casters 50. Rotation of the motor 20 in one direction will cause the cradle unwinder 14 to move transversely of the web 10 in one direction and rotation of the motor 20 in the other direction will cause the cradle unwinder to move transversely of the web 10 in the other direction.

Figure 7:
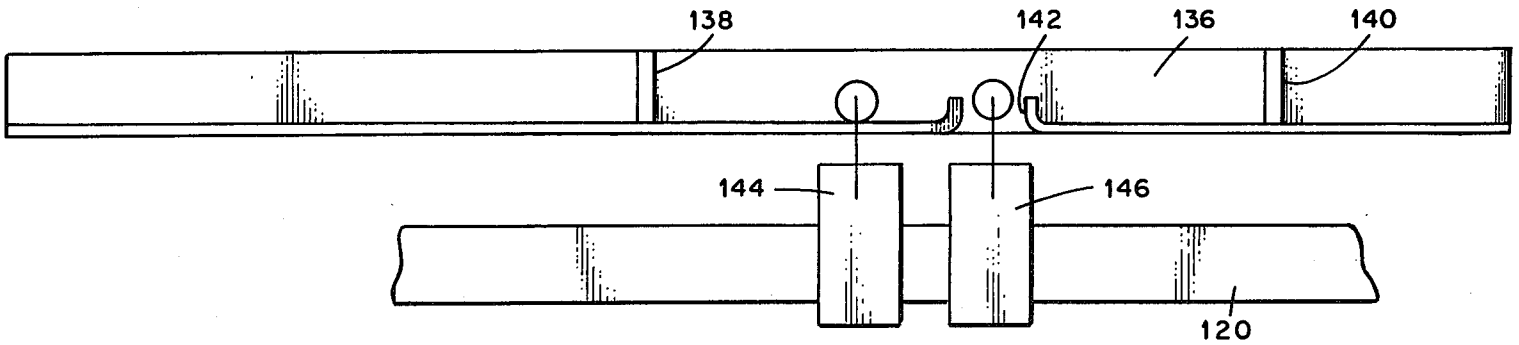
FIG. 7 is a front view of yet another component of the cradle unwinder; and, FIG. 8 is a schematic representation of a control circuit for the apparatus of FIG. 1.

The maximum lateral distance through which the cradle unwinder 14 can move is limited to prevent the cradle unwinder 14 from moving too far and off the inverted V-shaped lateral track members 28 of the floor mounted section 24. As illustrated in FIGS. 3 and 7, this is accomplished by end of travel limit means comprised of an elongated limit bar 136 attached to the cradle unwinder 14 for movement therewith. The limit bar 136 is disposed generally parallel to and in close proximity to the stationary force reduction member 120. The limit bar 136 includes two stops 138 and 140 spaced apart longitudinally of the limit bar 136 and an intermediate aperture 142 formed between the two stops 138 and 140. An end of travel limit switch 144 is attached to the stationary force reaction member 120 and is adapted to alternatively contact the two stops 138 and 140 as the limit bar 136 moves with the cradle unwinder 14 to the desired transverse extremety of movement of the cradle unwinder 14. When the end of travel limit switch 144 makes contact with one or the other of the stops 138 and 140, depending upon the transverse direction of movement of the cradle unwinder 14 at the time, control circuitry is activated to de-energize the electric motor 20 thereby stopping further transverse movement of the cradle unwinder 14. In addition, a gross centering switch 146 also attached to the stationary force reaction member 120 and is adapted to register with the intermediate aperture 142 formed in the limit bar 136 between the stops 138 and 140. Upon manual activation of the control circuitry, after the cradle unwinder 14 has moved to the extremity of its transverse movement in either direction, and has been stopped by the end of travel limit switch 144, the electric motor 20 is re-energized to cause the cradle unwinder 14 to move back in the other transverse direction. The gross centering switch 146 will register with the intermediate aperture 142 as the limit bar 136 moves with the cradle unwinder 14. Registration of the gross centering switch 146 with intermediate aperture 142 causes de-energization of the electric motor 20 and further movement of the cradle unwinder 14 is stopped. In this position, the cradle unwinder is approximately or grossly centered with the desired web alignment or path.

Figure 8:
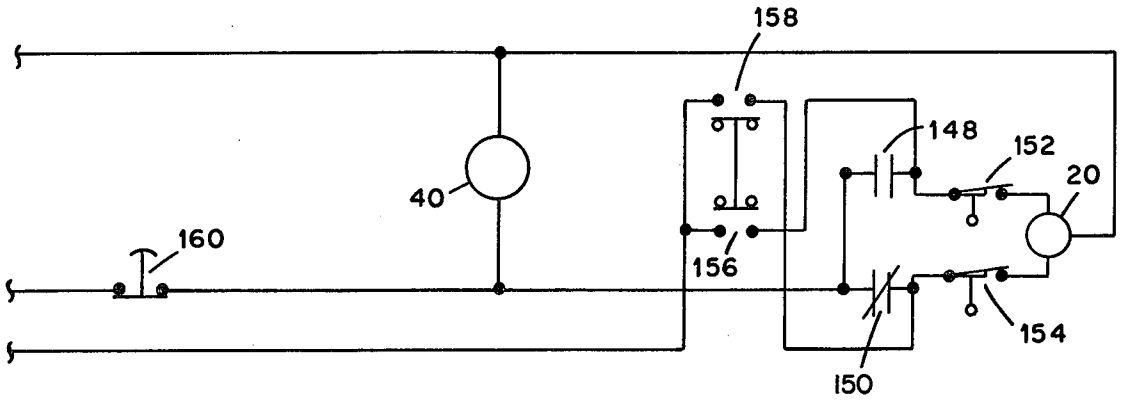

FIG. 8 illustrates in schematic form a control circuitry for controlling the electric motor 20 in response to appropriate signals from the detector 16, in response to the end of travel limit switch 144, and in response to the gross centering switch 146 all of which control the transverse movement and position of the cradle unwinder 14 under different circumstances. The illustrated control circuit comprises the photo electric edge detector 16 having a normally open photocell relay 148 in parallel with a normally closed photocell relay 150. The end of travel limit switch 144 includes a first normally closed contact 152 in parallel with a second normally closed contact 154. The first normally closed limit switch contact 152 is in series with the normally open photocell relay 148 and the second normally closed limit switch contact 154 is in series with the normally closed photocell relay 150. The first normally closed limit switch contact 152 is also in series with one side of the winding of the alternating current reversible electric motor 20 and the second normally closed limit switch contact 154 is in series with the other side of the winding of the reversible electric motor 20. The gross centering switch 146 is a double pole-double throw switch having a first normally open contact 156 and a second normally open contact 158 in parallel with the first normally open contact 156. The first normally open contact 156 of the gross centering switch is in series with the first normally closed limit switch contact 152 and the second normally open contact 158 of the gross centering switch 146 is in series with the second normally closed limit switch contact 154 shunting the normally open photocell relay 148 and normally closed photocell relay 150. In addition, a manually operated override switch 160 is included for selectively overriding the function of the end of travel switch 124.

In operation, with a web 10 of material being unwound from the supply roll 12, the photoelectric detector 16 continuously monitors the position of the edge 18 of the web 10. The reversible motor 20 will be turning in one direction thereby moving the cradle unwinder 14 in a corresponding transverse direction relative to the web. For the sake of initiating the discussion, it is assumed that the web 10 has deviated from the desired path in a transverse direction which blocks the light path between the photoelectric cell 40 and the light reflecting member 42 of the web edge detector 16 and, therefore, the photoelectric cell 40 is de-energized. In this mode, the normally closed photocell relay 150 is closed and the normally open photocell relay 148 is open. Thus, the motor 20 is rotating in one direction moving the cradle unwinder 14 in a first transverse direction to move the web 10 transversely in a direction to uncover the light path between the photoelectric cell 40 and light reflecting surface 42 of the photoelectric detector 16. When the light path between the photoelectric cell 40 and the light reflecting surface 42 becomes uncovered, the photoelectric cell 42 becomes energized opening the normally closed photocell relay 150 and closing the normally open photocell relay 148 in response to the light impinging the photoelectric cell 40. This causes the direction of rotation of the reversible motor 20 to be reversed causing the cradle unwinder 14 to move in the other or second transverse direction so that the web 10 will move transversely in a direction to cover the light path between the photoelectric cell 40 and light reflecting surface 42 of the photoelectric detector 16. When the light path between the photoelectric cell 40 and light reflecting surface 42 becomes covered, the photoelectric cell 40 de-energizes closing the normally closed photocell relay 150 and opening the normally open photocell relay 148 in response to the decreased light impinging the photoelectric cell 40. This causes the direction of rotation of the reversible motor 20 to again reverse causing the cradle unwinder 14 to again move back in the first transverse direction so that the web 10 will move transversely in a direction to uncover the light path between photoelectric cell 40 and light reflecting surface 42. In this way, the web 10 is maintained in the desired path.

When the supply roll 12 becomes exhausted, the light path between photoelectric cell 40 and light reflecting surface 42 will be completely uncovered just as if the web 10 has deviated from the desired path of travel. The photoelectric cell 40 will become energized opening the normally closed photocell relay 150 and closing the normally open photocell relay 148 in response to the light impinging on the photoelectric cell 40. This causes the electric motor 20 to drive the cradle unwinder 14 in one transverse direction, for example, the second transverse direction in a futile attempt to move the non-existent web in a transverse direction to cover the light path between the photoelectric cell 40 and light reflecting surface 42. As this occurs, the gross centering switch 146 will move out of registration with the intermediate aperture 142 of the limit bar 136 closing one of its normally open contacts, for example, the second normally open contact 158. Because the supply roll 12 is exhausted and there is no web 10 to cover the light path between the photoelectric cell 40 and light reflecting surface 42, the normally closed photocell switch 150 will remain open and the normally open photocell switch 148 will remain closed. The cradle unwinder 14 will continue to move transversely in the second transverse direction until the end of travel limit switch 144 contacts the stop 138. When this happens, the end of travel limit switch 144 activates to open one of the first or second limit switch contacts, for example, the first limit switch contact 152. This will result in de-energization of the reversible electric motor 20 because the normally closed photocell relay 150 is open and the first normally closed limit switch contact 152 is also open, opening the control circuit to both sides of the windings of the electric motor 20. Thus, transverse movement of the cradle unwinder 14 stops.

It is desirable that before a new supply roll 12 is loaded on the cradle unwinder 14 to supply a new web 10 of material that the cradle unwinder 14 be brought back to at least an approximate or gross center position relative to the desired path of travel of the web 10 from the extreme transverse location to which it moved upon exhaustion of the previous supply roll 12. To accomplish this gross centering, the manual override switch 160 is moved to complete an electrical circuit through the second normally open contact 158 of the gross centering switch 146, which is now closed as above discussed, and through the normally closed second limit switch contact 154 which is still closed, thus bypassing or shunting the photocell relays 148 and 150. This energizes the reversible motor 20 in the other rotational direction to move the cradle unwinder 14 in the opposite transverse direction, for example, the first transverse direction and back toward a generally or gross centered position. When the cradle unwinder 14 reaches the gross center position, the gross centering switch 146 registers with the intermediate aperture 142 in the limit bar 136 and opens the second normally open contact 158 of the gross centering switch 146 de-energizing the electric motor 20 causing the cradle unwinder 14 to stop at the gross centered position in preparation for the loading of a new supply roll 12.

In the event that the light source of the photoelectric cell 40 fails, the control circuitry will function as if a web of material is covering the light path between the photoelectric cell 40 and light reflecting surface 42. The photoelectric cell 40 will de-energize closing the normally closed photocell relay 150 and opening the normally open photocell relay 148 causing the motor 20 to rotate to move the cradle unwinder 14 in one transverse direction, for example, the first transverse direction in a futile attempt to move the web 10 in a transverse direction to uncover the light path between the photoelectric cell 40 and light reflecting surface 42. As this occurs, the gross centering switch 146 will move out of registration with the intermediate aperture 142 of the limit bar 136 closing one of its normally open contacts, for example, the first normally open contact 156. Because the photoelectric cell 40 is not illuminated and therefore de-energized, the normally open photocell relay 148 will remain open and the normally closed photocell relay 150 will remain closed. The cradle unwinder 14 will continue to move transversely in the first transverse direction until the end of travel limit switch 144 contacts the other of the stops 140. When this happens, the end of travel limit switch 144 activates to open one of the first or second limit switch contacts, for example, the second limit switch contact 154. This will result in de-energization of the reversible electric motor 20 because the normally open photocell relay 148 is open and the second normally closed limit switch contact 150 is also open, opening the control circuit to both sides of the windings of the electric motor 20. Thus, transverse movement of the cradle unwinder 14 stops.

To bring the cradle unwinder 14 back to at least an approximate or gross center position relative to the desired path of the web from the extreme lateral location to which it moved upon failure of the light source for the photoelectric cell 40, the manual override switch 160 is moved to complete an electric circuit through the first normally open contact 156 of the gross centering switch 126, which is now closed as discussed above, and through the normally closed first limit switch contact 152 which is still closed. Thus, the photocell switches 148 and 150 are bypassed or shunted. This energizes the reversible motor 20 in the other rotational direction to move the cradle unwinder 14 in the opposite transverse direction, for example, the second transverse direction and back toward a generally or gross centered position. When the cradle unwinder 14 reaches the gross center position, the gross centering switch 148 registers with the intermediate aperture 142 in the limit bar 136 and opens the first normally open contact 156 of the gross centering switch 146 deactivating the electric motor 20 causing the cradle unwinder to stop at the general or gross centered position.

The foregoing detailed description is given primarily for clearness of understanding, and no unnecessary limitations should be understood therefrom for modifications will be obvious to those skilled in the art upon reading this disclosure and can be made without departing from the spirit of the invention or the scope of the appended claims.

What is claimed is:

1. An apparatus for unwinding a web of material from a supply roll and monitoring and correcting the alignment of the continuously moving web of material as the web unwinds from the supply roll, comprising:

a cradle unwinder for supporting the supply roll of material and for unwinding the web from the supply roll;

means for mounting said cradle unwinder for movement transversely of the direction of movement of the web;

detecting means disposed at one edge of the web of material unwinding from the supply roll for detecting transverse deviations of the web from the desired path of travel;

a reversible motor mounted to said cradle unwinder and operatively associated with said detecting means for energization in response to a signal from said detecting means indicating the web has transversely deviated from the desired path of travel;

force reaction means stationary with respect to said cradle unwinder; and, chain and sprocket means mounted on said cradle unwinder with the chain disposed transversely of the web and interconnecting said reversible motor and said force reaction means, the chain being fixedly attached at one of its lengths to said force reaction means for transferring the driving force generated by said reversible motor to said cradle unwinder and moving said cradle unwinder in a transverse direction of the web to maintain the web in the desired path of travel.

2. The apparatus of claim 1, further comprising:

supply roll abutting means movably mounted to said cradle unwinder for selectively abutting one end of a supply roll supported on said cradle unwinder; and, means for locking said abuttment means against one end of a supply roll.

3. The apparatus of claim 2, further comprising:

a truck movably supported on said cradle unwinder for selected movement in the direction of the longitudinal axis of the supply roll supported in the cradle unwinder; and, said abuttment means being attached to said truck for movement therewith into and out of abuttment against one end of the supply roll.

4. The apparatus of claim 2, wherein said lock means comprises:

means defining a plurality of spaced apart detents associated with said cradle unwinder and extending generally in the direction of the longitudinal axis of the supply roll supported on said cradle unwinder; and, detent engaging means associated with said abuttment means for selectively engaging and disengaging selected detents and thereby locking and unlocking said abuttment means against inadvertant movement.

5. An apparatus for unwinding a web of material from a supply roll and monitoring and correcting the alignment of the continuously moving web of material as the web unwinds from the supply roll, comprising:

a cradle unwinder for supporting the supply roll of material and for unwinding the web from the supply roll;

said cradle unwinder having at least three parallel supply roll support rollers disposed in said cradle unwinder transversely of the web for supporting the supply roll with its longitudinal axis parallel to the longitudinal axis of said support rollers and having means for rotating said support rollers in the same rotational direction causing the supply roll of material to rotate unwinding a web of material from the supply roll;

means for mounting said cradle unwinder for movement transversely of the direction of movement of the web;

detecting means disposed at one edge of the web of material unwinding from the supply roll for detecting transverse deviations of the web from the desired path of travel;

a reversible motor mounted to said cradle unwinder and operatively associated with said detecting means for energization in response to a signal from said detecting means indicating the web has transversely deviated from the desired path of travel;

force reaction means stationary with respect to said cradle unwinder; and, means interconnecting said reversible motor and said force reaction means for transferring the driving force generated by said reversible motor to said cradle unwinder and moving said cradle unwinder in a transverse direction of the web to maintain the web in the desired path of travel.

6. The apparatus of claim 5, wherein said means for rotating said support rollers comprises:

at least one driven gear sprocket attached to one end of each of said support rollers;

a motor;

a gear driving sprocket operatively associated with said motor for rotation therewith; and, at least one drive chain operatively encompassing said driven sprockets and said driving sprocket.

7. An apparatus for unwinding a web of material from a supply roll and monitoring and correcting the alignment of the continuously moving web of material as the web unwinds from the supply roll, comprising:

a cradle unwinder for supporting the supply roll of material and for unwinding the web from the supply roll;

stationary track means extending transversely of the moving web;

caster means rotably mounted to said cradle unwinder and traveling on said track means for mounting said cradle unwinder for movement transversely of the direction of movement of the web;

detecting means disposed at one edge of the web of material unwinding from the supply roll for detecting transverse deviations of the web from the desired path of travel;

a reversible motor mounted to said cradle unwinder and operatively associated with said detecting means for energization in response to a signal from said detecting means indicating the web has transversely deviated from the desired path of travel;

force reaction means stationary with respect to the cradle unwinder; and, means interconnecting said reversible motor and said force reaction means for transferring the driving force generated by said reversible motor to said cradle unwinder and moving said cradle unwinder in a transverse direction of the web to maintain the web in the desired path of travel.

8. An apparatus for unwinding a web of material from a supply roll and monitoring and correcting the alignment of the continuously moving web of material as the web unwinds from the supply roll, comprising:

a cradle unwinder for supporting the supply roll of material and for unwinding the web from the supply roll;

means for mounting said cradle unwinder for movement transversely of the direction of movement of the web;

detecting means disposed at one edge of the web of material unwinding from the supply roll for detecting transverse deviations of the web from the desired path of travel;

a reversible motor mounted to said cradle unwinder and operatively associated with said detecting means for energization in response to a signal from said detecting means indicating the web has transversely deviated from the desired path of travel;

force reaction means stationary with respect to said cradle unwinder;

means interconnecting said reversible motor and said force reaction means for transferring the driving force generated by said reversible motor to said cradle unwinder and moving said cradle unwinder in a transverse direction of the web to maintain the web in the desired path of travel;

limit switch means operatively associated with said reversible motor;

means defining the extremety of transverse movement of said cradle unwinder and for activating said limit switch means when said cradle unwinder has reached the extremety whereupon said limit switch means de-activates said reversible motor;

means operatively associated with said reversible motor for selectively re-activating said reversible motor when said cradle unwinder is at the extremety of its movement regardless of said limit switch means;

center limit switch means operatively associated with said reversible motor; and, means defining generally the center of the desired path of travel of said web for activating said center limit switch means when said cradle unwinder has reached the approximate center whereupon said center limit switch means de-activates said cradle unwinder moving means.

* * * * *